US008449813B1

(12) United States Patent
Lim et al.

(10) Patent No.: US 8,449,813 B1
(45) Date of Patent: May 28, 2013

(54) DEOXIDATION APPARATUS FOR PREPARING TITANIUM POWDER WITH LOW OXYGEN CONCENTRATION

(75) Inventors: Jae-Won Lim, Daejeon (KR); Jung-Min Oh, Daejeon (KR); Back-Kyu Lee, Daejeon (KR); Chang-Youl Suh, Daejeon (KR); Sung-Wook Cho, Daejeon (KR)

(73) Assignee: Korea Institute of Geoscience and Mineral Resources (KR)

( * ) Notice: Subject to any disclaimer, the term of this patent is extended or adjusted under 35 U.S.C. 154(b) by 0 days.

(21) Appl. No.: 13/551,409

(22) Filed: Jul. 17, 2012

(30) Foreign Application Priority Data

Nov. 18, 2011 (KR) ..... 10-2011-0120835

(51) Int. Cl.
*C21C 5/48* (2006.01)

(52) U.S. Cl.
USPC ..... 266/171; 75/612

(58) Field of Classification Search
USPC ..... 266/171; 75/362, 612, 613
See application file for complete search history.

(56) References Cited

U.S. PATENT DOCUMENTS

| | | | | |
|---|---|---|---|---|
| 2,482,127 | A * | 9/1949 | Schlechten et al. | 266/171 |
| 2,793,107 | A * | 5/1957 | Jazwinski et al. | 75/362 |
| 2006/0162496 | A1 | 7/2006 | Asai et al. | |
| 2009/0214378 | A1 | 8/2009 | Haas et al. | |

FOREIGN PATENT DOCUMENTS

| | | |
|---|---|---|
| JP | 2008-88513 | 4/2008 |
| JP | 2010-105907 | 5/2010 |
| KR | 10-2005-0049505 | 5/2005 |
| KR | 10-2007-0051957 | 5/2007 |

* cited by examiner

*Primary Examiner* — Scott Kastler
(74) *Attorney, Agent, or Firm* — Christie, Parker & Hale, LLP

(57) ABSTRACT

Disclosed is a deoxidation apparatus for preparing low-oxygen titanium powders. The deoxidation apparatus includes a lower container having an open upper portion and storing an deoxidizer representing an oxygen degree higher than an oxygen degree of titanium and a melting temperature lower than a melting temperature of titanium, and an upper container coupled with the lower container on the lower container and storing titanium base powders. The upper container is provided at a lower surface thereof with a sieve, and allows the deoxidizer, which is evaporated due to heating, to make contact with the titanium base powders so that the titanium base powders are deoxidized.

4 Claims, 3 Drawing Sheets

DEOXIDATION APPARATUS FOR PREPARING TITANIUM POWDER WITH LOW OXYGEN CONCENTRATION

CROSS-REFERENCE TO RELATED APPLICATION

This application claims the benefit under 35 U.S.C. §119 of Korean Patent Application No. 10-2011-0120835 filed on Nov. 18, 2011 in the Korean Intellectual Property Office, the entirety of which disclosure is incorporated herein by reference.

BACKGROUND OF THE INVENTION

1. Field of the Invention

The present invention relates generally to a technique for preparing titanium powders. In more particular, the present invention relates to a deoxidation apparatus for preparing a low-oxygen titanium powder having an oxygen concentration of 1,000 ppm or less from common titanium powders having an oxygen concentration of about 2,200 ppm.

2. Description of the Related Art

Titanium (Ti) is a material representing very superior durability and corrosion resistance with a light weight. Accordingly, titanium (Ti) has been utilized in various fields such as an aerospace field, an ocean equipment field, a chemical industry field, a nuclear power generation field, a biomedical field, and an automobile field.

Common titanium (Ti) has an oxygen concentration of about 2,000 ppm to about 10,000 ppm. Accordingly, many researches and studies have been performed to prepare higher-purity titanium.

The researches and studies on the preparation of the high-purity titanium are mainly focused on the control of gas impurities, that is, the development of a deoxidation process.

In order to reduce oxygen from titanium through the deoxidation process, there is suggested a scheme of dissolving calcium (Ca) by using halide flux such as calcium chloride ($CaCl_2$), and dissolving calcium oxide (CaO) come from the deoxidation process in the flux. However, according to the scheme based on the halide flux, a complex mechanical process such as a pulverizing process must be performed after the deoxidation process has been performed. If the source material has the form of powders, superior powders may not be obtained through the process.

The related art of the present invention discloses high-purity titanium and a method for preparing the same in Korean Unexamined Patent Application No. 10-1987-0011265 (published on Dec. 22, 1987).

SUMMARY OF THE INVENTION

Accordingly, the present invention has been made keeping in mind the above problems occurring in the prior art, and an object of the present invention is to a deoxidation apparatus for preparing low-oxygen titanium powders, capable of reducing oxygen concentration from common titanium powders by improving the deoxidation efficiency of the titanium powders.

To accomplish one object, according to one aspect of the present invention, there is provided the deoxidation apparatus for preparing low-oxygen titanium powders. The deoxidation apparatus includes a lower container having an open upper portion and storing an deoxidizer representing an oxygen degree higher than an oxygen degree of titanium and a melting temperature lower than a melting temperature of titanium, and an upper container coupled with the lower container on the lower container and storing titanium base powders. The upper container is provided at a lower surface thereof with a sieve, and allows the deoxidizer, which is evaporated due to heating, to make contact with the titanium base powders so that the titanium base powders are deoxidized.

In this case, the deoxidation apparatus may further include a deoxidizer storing cup provided in the lower container to directly store the deoxidizer.

In addition, the deoxidation apparatus may further include a gasket to fix an edge of the sieve.

Further, the deoxidation apparatus may further include an external container to receive the upper container and the lower container. In this case, the deoxidation apparatus may further include at least one of an upper container cover to seal the upper container and an external container cover to seal the external container.

As described above, according to the deoxidation apparatus of the present invention, titanium base powders are subject to the deoxidation process by using a deoxidizer, such as calcium, representing a low melting point and a high oxidation degree, and the deoxidation process is performed at the temperature of the melting point of the deoxidizer or more.

Therefore, the titanium powders prepared by using the apparatus according to the present invention can have the oxygen concentration of 1,000 ppm or less.

DETAILED DESCRIPTION OF THE INVENTION

Figure 1:
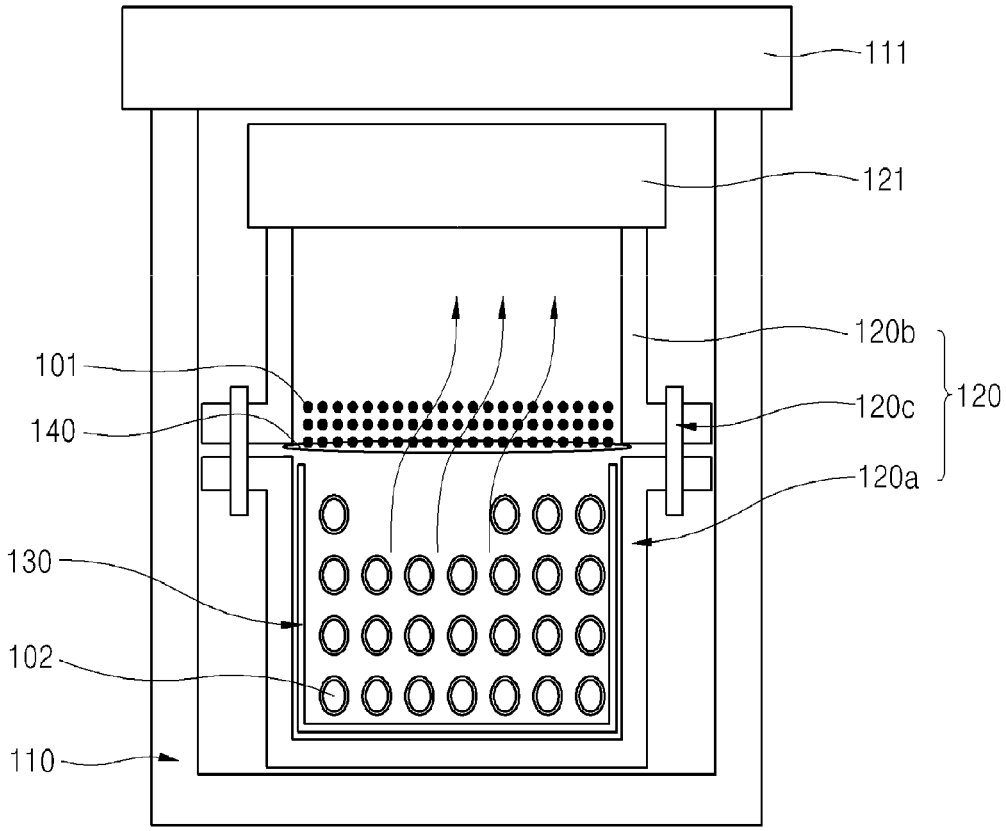
FIG. 1 is a view showing a deoxidation apparatus for preparing low-oxygen titanium powders according to the present invention.

Advantages and/or characteristics of the present invention, and methods to accomplish them will be apparently comprehended by those skilled in the art when making reference to embodiments in the following description and accompanying drawings. However, the present invention is not limited to the following embodiments, but various modifications may be realized. The present embodiments are provided to make the disclosure of the present invention perfect and to make those skilled in the art perfectly comprehend the scope of the present invention. The present invention is defined only within the scope of claims. The same reference numerals will be used to refer to the same elements throughout the specification.

Hereinafter, a deoxidation apparatus for preparing low-oxygen titanium powders and a method for preparing the low-oxygen titanium powders by using the same according to an exemplary embodiment of the present invention will be described in detail with reference to accompanying drawings.

FIG. 1 is a view schematically showing a deoxidation apparatus for preparing low-oxygen titanium powders according to the present invention.

Referring to FIG. 1, the apparatus for preparing low-oxygen titanium powders according to the present invention includes a lower container 120*a* and an upper container 120*b*.

The lower container 120*a* has an open upper portion. The lower container 120*a* stores a deoxidizer 102 representing an oxygen degree higher than that of titanium and a melting temperature lower than that of the titanium. The deoxidizer 102 may include calcium (Ca).

The upper container 120*b* is coupled with the lower container 120*a* on the lower container 120*a*. The upper container 120*b* stores titanium base powders 101. The upper container 120*b* is coupled with the lower container 120*a* by a coupling part 120*c*.

In this case, according to the present invention, the upper container 120*b* is provided at a lower surface thereof with a sieve 140. In order to prevent the titanium base powders from being dropped to the lower container 120*b*, the sieve 140 preferably has a mesh greater than the mesh of the titanium base powders. For example, if the titanium base powder has 80 mesh, the sieve 140 may have 100 mesh.

In addition, in order to fix the sieve 140, the deoxidation apparatus may further include a gasket (not shown) to fix the edge of the sieve 140.

Since the lower surface of the upper container 120*b* is provided with the sieve 140, the deoxidizer 102 evaporated due to heating makes contact with the titanium base powder 101 to remove oxygen from the titanium base powders 101.

Meanwhile, if the inner part of the lower container 120*a* is heated at the melting temperature or more, the deoxidizer 102 is melted. In this case, after the deoxidation apparatus has been used, the deoxidizer 102 is coagulated. Accordingly, the deoxidizer 102 sticking to the inner part of the lower container 120*a* may not be completely removed from the lower container. Therefore, the reuse of the lower container 120*a* may be difficult.

In order to solve the problem, the deoxidation apparatus may further include a disposable deoxidizer storing cup installed in the lower container 120*a* to directly store the deoxidizer 102.

In addition, referring to FIG. 1, the deoxidation apparatus may further include an external container 110 receiving the internal container 120 including the lower container 120*a* and the upper container 120*b*. The external container 110 and the internal container 120 may include steel.

In addition, the deoxidation apparatus may further include an internal container cover 121 to seal the entire portion of the internal container 120 by sealing the upper container 120*a*. Further, the deoxidation apparatus may further include an external container cover 111 to seal the external container 110. Accordingly, the deoxidizer 120 evaporated can be prevented from leaking by sealing the external container 110 or the internal container 120. Most preferably, the deoxidation apparatus may include both of the external container cover 111 and the internal container cover 121.

Figure 2:
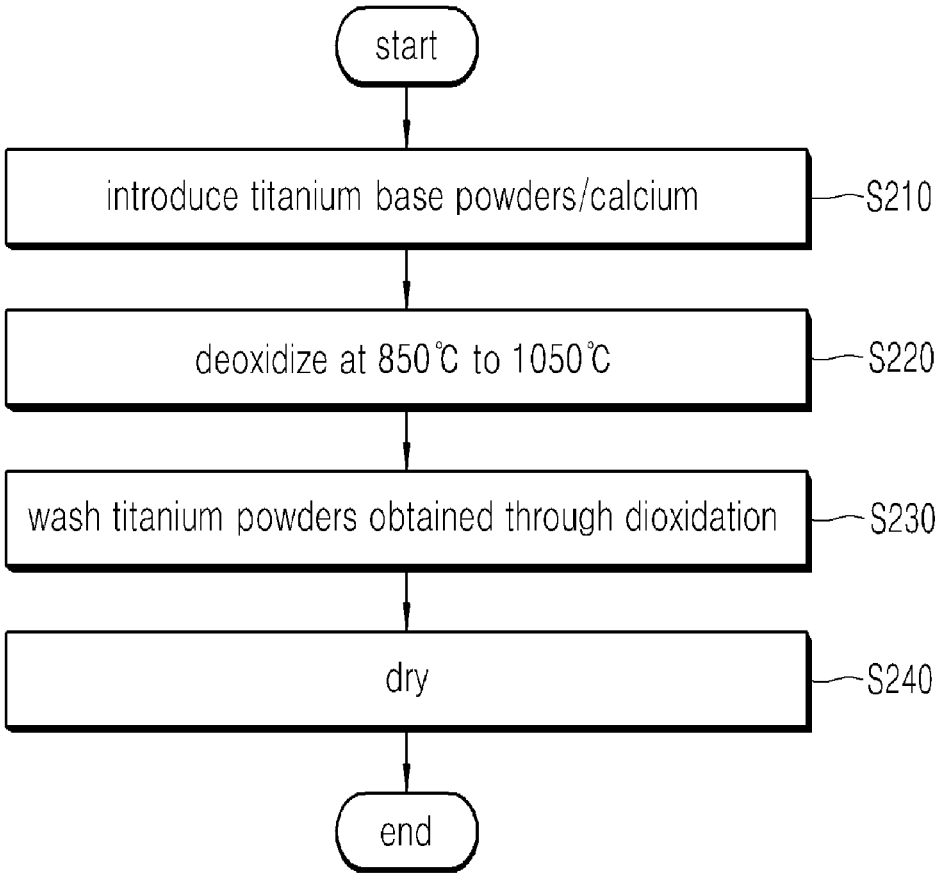
FIG. 2 is a flowchart schematically showing a method for preparing low-oxygen titanium powders according to the present invention.

FIG. 2 is a flowchart schematically showing a method for preparing low-oxygen titanium powders according to the present invention. In more detail, the deoxidizer 120 may include calcium (Ca).

Referring to FIG. 2, the method for preparing low-oxygen titanium powders includes a step of placing titanium base powders/calcium (step S210), a deoxidation step (step S220), a washing step (step S230), and a drying step (step S240).

In the step of placing titanium base powders/calcium (step S210), titanium base powders are introduced into the upper container, and the deoxidizer, which represents a melting point lower than that of titanium and an oxygen degree higher than that of titanium, is introduced into the lower container. Thereafter, the upper container is coupled with the lower container on the lower container.

The titanium base powders include common titanium powders having the oxygen concentration of about 2,200 ppm.

In order to remove oxygen from the titanium base powders, the deoxidizer may include materials representing the oxygen degree higher than that of titanium. In addition, according to the present invention, the evaporated deoxidizer makes contact with the titanium. To this end, the deoxidizer may include a material representing a melting temperature lower than that of titanium. The deoxidizer satisfying the above condition may include calcium (Ca).

If calcium (Ca) is used as the deoxidizer, 100 weight part of titanium base powders and 50 weight part to 200 weight part of calcium may be introduced. If an amount of used calcium represents the content of 50 weight part with respect to 100 weight part of titanium base powders, an amount of evaporated calcium is insufficient so that deoxidation effect may be degraded. In contrast, if more than 200 weight part of calcium is used with respect to 100 weight part of titanium base powders, only an amount of used calcium may be increased without the improvement of the deoxidation effect.

Next, in the deoxidation step (step S20), the deoxidizer is evaporated while making contact with the titanium base powders by heating the inner part of the deoxidation container at the temperature of the melting point of the deoxidizer or more for about one hour to about three hours. When the evaporated deoxidizer makes contact with the titanium base powders, the following deoxidation reaction occurs, so that oxygen is removed from the titanium base powders.

$$M(g)+O(\text{in Ti powder})\rightarrow MO(M:\text{deoxidizer}).$$

Naturally, the deoxidation reaction occurs at the temperature of less than the melting point of deoxidizer. However, when the deoxidation processes are performed at the temperature of less than the melting point of the deoxidizer and more than the melting point of the deoxidizer under the same condition, the deoxidation process performed at the temperature of more than the melting point of the deoxidizer represents deoxidation effect greater than that of the deoxidation process performed at the temperature of less than the melting point of the deoxidizer. Accordingly, in the present invention, the deoxidation process is performed at the temperature of more than the melting point of the deoxidizer.

Meanwhile, if calcium is used as the deoxidizer, the deoxidation temperature is preferably in the range of 850° C. to 1050° C. If the deoxidation temperature is less than 850° C., an amount of evaporated calcium may be insufficient. In contrast, if the deoxidation temperature exceeds 1050° C., calcium oxide (CaO) may not be completely removed from the surface of the titanium powders due to the sintering and the cohesion phenomenon. Accordingly, low-oxygen titanium powders may not be acquired.

Thereafter, in the washing step (step S230), a deoxidizer oxide is removed from the surface of titanium powders by washing the titanium powders that has been deoxidized in the deoxidation step (step S220).

The impurities on the surface of the deoxidized titanium powders may include MO(s) come from the deoxidation process.

The washing step (step S130) may be performed through at least one of a water washing process and an acid washing process. In the case of the acid washing process, about 10 weight % of an HCl solution can be used. In order to acquire low-oxygen titanium powder, the water washing process and the acid washing process are preferably repeated several times.

Thereafter, in the drying step (step S240), the titanium powders without the calcium oxide (CaO) is dried.

Although the titanium powders are dried through various schemes, a vacuum drying scheme is more preferable in order to obtain the low-oxygen titanium powders.

The vacuum drying scheme may be performed at the temperature of about 60° C. for 2 hours.

EMBODIMENT

Hereinafter, the deoxidation apparatus for preparing the low-oxygen titanium powders and the method for preparing the low-oxygen titanium powders by using the same according to the exemplary embodiment of the present invention will be described. The following exemplary embodiments are illustrative purpose only and the present invention is not limited thereto.

Description about known functions and structures, which can be anticipated by those skilled in the art, will be omitted.

1. Preparation of Titanium Powders

First Embodiment

A deoxidation process was performed by employing common titanium powders (99.9%, high-purity chemical, Japan) having an oxygen concentration of 2,200 ppm as titanium base powders and using metallic calcium. An average particle size of the titanium base powder was analyzed as 150 μm. Titanium powders were introduced into the deoxidation container shown in FIG. 1 together with calcium having the content of 100 weight % based on the weight of the titanium. The deoxidation process was performed at the temperature of about 900° C. for 2 hours. The experimental equipment for the experiment included the deoxidation apparatus of FIG. 1.

Thereafter, titanium powders were acquired by performing a vacuum drying process at the temperature of about 60° C. for 2 hours after performing the water washing process and the acid washing process (10 weight % HCl solution) with respect to the deoxidized titanium powders three times.

Second Embodiment

Titanium powders was acquired under the same condition as that of the first embodiment except that the deoxidation process was performed at the temperature of 1000° C.

First Comparative Example

The deoxidation process was performed at the temperature of 800° C. Different from the first embodiment, titanium powders was acquired under the condition in which titanium base powders were placed together with calcium for the deoxidation process.

Second Comparative Example

Titanium powders was acquired under the same condition as that of the first embodiment except that the deoxidation process was performed at the temperature of 1,100° C.

2. Measurement of Oxygen Concentration

Figure 3:
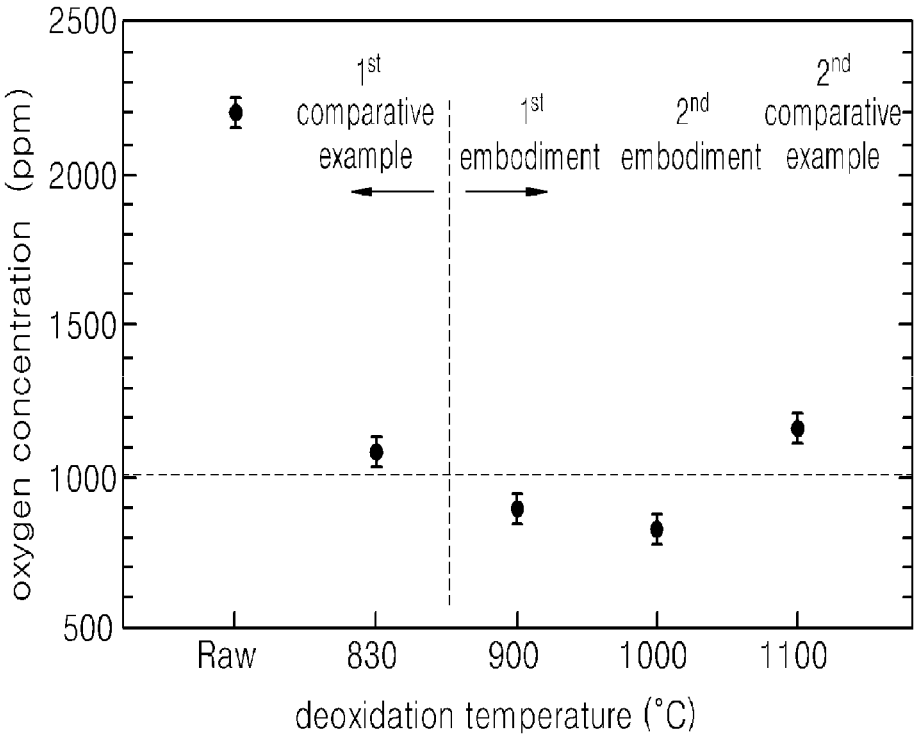
FIG. 3 is graph showing the oxygen concentration of titanium powders prepared according to the first and second embodiments and the first and second comparative examples.

Thereafter, oxygen concentration of the titanium powders prepared according to the first and second embodiments and the first and second comparative examples was measured by using an oxygen/nitrogen analyzer (LECO TC-436), and the measurement results are shown in FIG. 3.

Referring to FIG. 3, titanium powders, which were prepared according to the first and second embodiments employing a deoxidation temperature equal to or greater than the melting temperature (848° C.) of calcium, represented oxygen concentration of 1,000 ppm or less.

In contrast, titanium powers, which were prepared according to the first comparative example employing a deoxidation temperature less than the melting temperature of calcium, and titanium powders, which were prepared according to the second comparative example employing a deoxidation temperature exceeding 1,050° C., represented the oxygen concentration of 1,000 ppm.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A deoxidation apparatus for preparing low-oxygen titanium powders, the deoxidation apparatus comprising:

a lower container having an open upper portion and storing an deoxidizer representing an oxygen degree higher than an oxygen degree of titanium and a melting temperature lower than a melting temperature of titanium;

a deoxidizer storing cup provided in the lower container to directly store the deoxidizer; and an upper container coupled with the lower container on the lower container and storing titanium base powders, wherein the upper container has at a lower surface thereof a sieve which separates the upper container from the lower container, and allows the deoxidizer, which is evaporated upwards through the sieve upon heating, to make contact with the titanium base powders so that the titanium base powders are deoxidized.

2. The deoxidation apparatus of claim 1, further comprising a gasket to fix an edge of the sieve.

3. The deoxidation apparatus of claim 1, further comprising an external container to receive the upper container and the lower container.

4. The deoxidation apparatus of claim 3, further comprising at least one of an upper container cover to seal the upper container and an external container cover to seal the external container.

* * * * *